United States Patent [19]

Anhalt

[11] 4,441,776

[45] Apr. 10, 1984

[54] QUICK DETACHABLE COUPLING

[75] Inventor: John W. Anhalt, Orange, Calif.

[73] Assignee: ITT Corporation, New York, N.Y.

[21] Appl. No.: 319,457

[22] Filed: Nov. 9, 1981

[51] Int. Cl.[3] ..... H01R 13/62

[52] U.S. Cl. ..... 339/91 R; 339/74 R

[58] Field of Search ..... 339/74 R, 91 R

[56] References Cited

U.S. PATENT DOCUMENTS

| | | | |
|---|---|---|---|
| Re. 31,142 | 2/1983 | Simmons | 339/74 R |
| 3,133,777 | 5/1964 | Anhalt | 339/211 |
| 3,639,950 | 2/1972 | Lutz et al. | 339/74 R |
| 3,828,300 | 8/1974 | Codrino | 339/74 R |
| 3,901,575 | 8/1975 | Hoover | 339/91 R |
| 3,970,353 | 7/1976 | Kaufman | 339/91 R |
| 4,167,299 | 9/1979 | Noguchi | 339/74 R |
| 4,222,624 | 9/1980 | Eme et al. | 339/91 R |

FOREIGN PATENT DOCUMENTS

| | | | |
|---|---|---|---|
| 1196099 | 6/1970 | United Kingdom | 339/91 R |
| 1597164 | 9/1981 | United Kingdom | 339/74 R |

*Primary Examiner*—Joseph H. McGlynn
*Assistant Examiner*—Gary F. Paumen
*Attorney, Agent, or Firm*—T. E. Kristofferson; T. L. Peterson

[57] ABSTRACT

A quick detachable coupling for use on electrical connectors or the like in which the plug has a latching tab formed on a resilient arm. The tab engages a latching shoulder formed in a recess in the receptacle of the coupling when the plug and receptacle are mated. A live hinge member on the housing of the receptacle is actuated to push the latching tab on the resilient arm out from the latching shoulder into a release slot which allows the plug to be slidably disengaged from the receptacle.

11 Claims, 6 Drawing Figures

QUICK DETACHABLE COUPLING

BACKGROUND OF THE INVENTION

The present invention relates generally to a quick detachable coupling and, more particularly, to such a coupling which is particularly suited for electrical connectors.

While the coupling arrangement of the present invention will be described specifically in connection with an electrical connector, it will be appreciated that the coupling may be used with other elements which require a positive interconnection yet a quick detachment.

It is common practice in the electrical connector art to provide integral latching arrangements on plastic connectors which will allow positive locking together of the mating connector halves thereby insuring that electrical continuity is maintained under varying conditions of vibration and separating forces which would otherwise result in the loss of electrical continuity. Typically, the latching arrangement includes an integral, molded-in lever which is pivotable about a leg that extends laterally outwardly from the housing of one of the connector halves. The lever embodies a latch shoulder which is engageable with a catch on the mating connector half when the two halves are interengaged. While such latching arrangements are generally satisfactory, they have a relatively high profile which may be objectionable if space is at a premium in the environment in which connector is intended to be used.

U.S. Pat. No. 3,133,777 discloses a plastic electrical connector in which a flexible, oval shaped outer ring on one connector half embodies a latching recess which cooperates with a lug on the mating connector half when the two halves are interengaged. While this latching arrangement allows the connector to have a low profile, the oval sleeve disposed around the periphery of the connector is subject to damage during handling of the connector.

Copending application of J. W. Anhalt et al. entitled "Electrical Connector," Ser. No. 177,005, filed Aug. 11, 1980, assigned to the assignee of the present application, discloses an electrical connector assembly in which a latching lever is formed in the wall of the receptacle of the assembly. The lever has a latch shoulder engagable with a catch on the mating plug. The lever is pivotably mounted on the receptacle connector housing by integral live hinge pivots which extend laterally from the sides of the lever so that the lever is pivotable about an axis passing laterally through the receptacle housing, thereby providing a low profile.

It is the object of the present invention to provide an improved quick detachable coupling arrangement for an electrical connector or the like which has a low profile, provides a positive interlock between the plug and receptacle, may be rapidly disengaged, and is suitable for application in miniature form.

SUMMARY OF THE INVENTION

According to a principal aspect of the present invention there is provided a quick detachable coupling comprising mating plug and receptacle members in which a recess is formed in the receptacle which slidably receives the plug member. A rearwardly facing latching shoulder is formed on one side of the recess spaced from the other side thereof providing a release slot therebetween. The plug member embodies a latching tab on the side thereof adjacent to the shoulder. The tab normally lies behind and in alignment with the shoulder for latching the plug and the receptacle members together. The tab is movable into the release slot out of engagement with the latching shoulder by a selectively shiftable element on the receptacle thereby allowing disengagement of the plug and receptacle members.

DESCRIPTION OF THE PREFERRED EMBODIMENT

Figure 1:
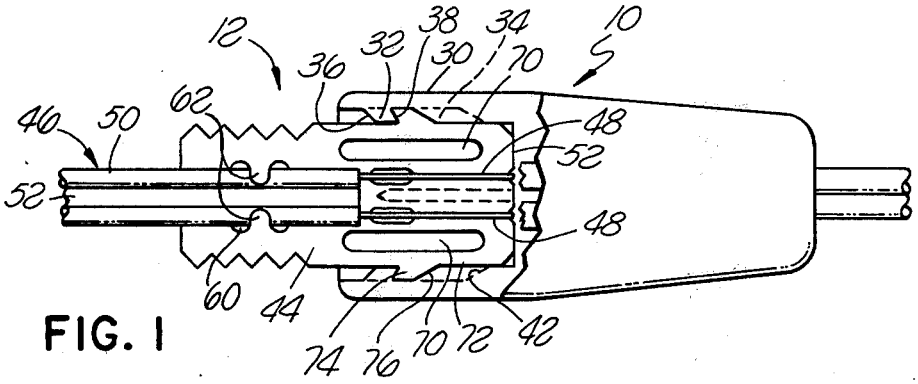
FIG. 1 is a top plan view of the connector of the present invention showing the plug fully inserted into the receptacle, with a portion of the upper wall of the receptacle housing removed to show how latching is achieved between the plug and receptacle.

Referring now to the drawings in detail, the connector of the present invention, generally designated 10, comprises a plug 12 which slidably fits into a rectangular recess 14 opening at the front 16 of a receptacle 18. As illustrated, the plug and receptacle have a generally rectangular cross-section. The receptacle is composed of an upper part 20 and a lower part 22 which may be molded from plastic and fastened together by ultrasonic welding or mechanical fasteners, not shown. The upper and lower parts of the receptacle form a housing 24 including upper and lower walls 26 and 28, respectively, and two side walls 30. A reverse angle projection 32 is formed on the interior of each side wall 30. Each projection extends from the upper wall 26 downwardly but spaced from the lower wall 28 to provide a pair of longitudinally extending release slots 34. Each projection is formed with an inclined forwardly facing camming surface 36 and a rearwardly facing latching shoulder 38. A notch 40 is formed behind each projection 32. Each slot 34 extends from the front 16 of the receptacle housing to a shoulder 42 which is positioned rearwardly of the notch 40.

Figure 3:
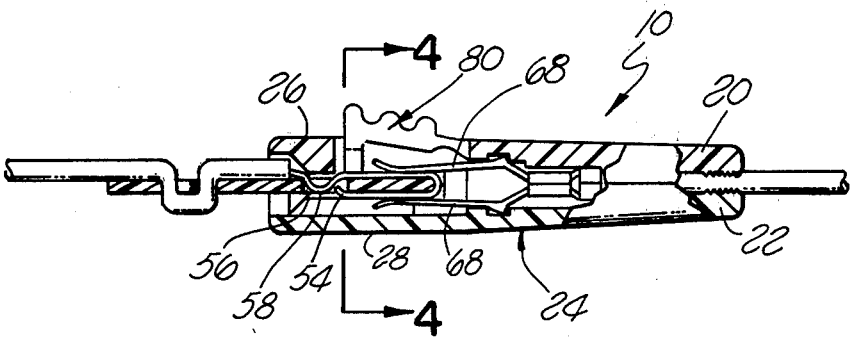
FIG. 3 is a vertical, longitudinal sectional view through the fully mated connector of the invention.

The mating plug 12 comprises a generally flat plastic body or plate 44 which is connected to a cable 46. The cable comprises a pair of parallel conductors 48 each covered by an insulation jacket 50 and interconnected by an intermediate web portion 52. The conductors 48 are reversely bent around the front 52 of the plug plate, as best seen in FIG. 3, with the terminal end 54 of each conductor extending into an opening 56 in the plate. An intermediate portion 58 of each conductor is bent downwardly into the opening 56. By this arrangement, the conductors are properly positioned and retained on the plug plate. A generally rectangular slot 60 is formed in the rear portion of the plug plate. A pair of fingers 62 extend inwardly from the sides of the slot. The cable 46 is threaded through the slot 60 around the fingers 62 as best seen in FIG. 3 to provide strain relief for the cable.

The receptacle housing contains a pair of female contacts 64 connected to two conductors 66. The contacts are positioned in the housing to mate with the conductors 48 on the plug 12 when the plug is inserted into the recess 14 in the receptacle housing. As shown, each female contact embodies a pair of forwardly extending relatively flat spring beams 68 which spread apart when the plug 12 is inserted into the receptacle providing electrical interconnection between the conductors 48 and 66.

Figure 2:
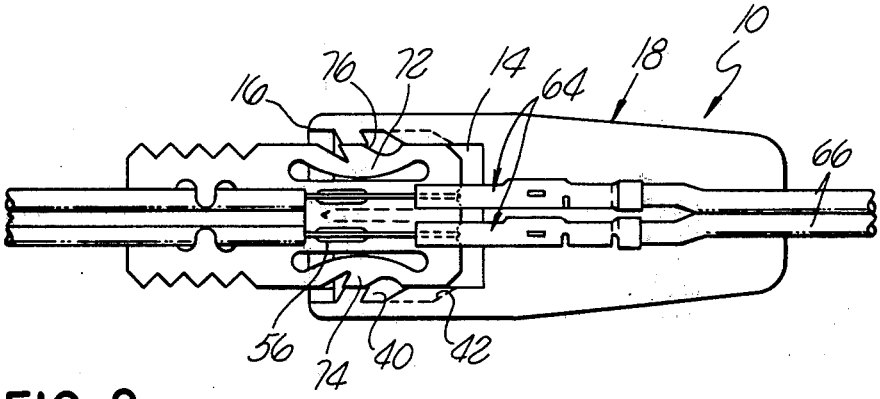
FIG. 2 illustrates the plug partially inserted into the receptacle.

A pair of longitudinal extending slots 70 are formed in the forward portion of the plug plate 44 defining a pair of resilient arms 72. Each arm is formed with an outwardly extending reverse angle latching tab which is dimensioned to fit within a corresponding notch 40 in the receptacle housing when the plug and receptacle are fully mated as seen in FIG. 1. Each latching tab embodies a forwardly facing inclined surface 76 which cooperates with the camming surface 36 on a corresponding projection 32 so that when the plug is initially pushed into the receptacle recess the surface 76 will engage the camming surface 36 causing the resilient arm 72 to flex inwardly, as seen in FIG. 2, so that the tab may pass the projection 32 and snap into the notch 40 after the tab passes the latching shoulder 38 on the receptacle. Axial loads applied to the plug in the direction of unmating will cause the latching tabs to travel outwardly which enhances the positive locking which occurs between the plug and receptacle when mated.

Figure 4:
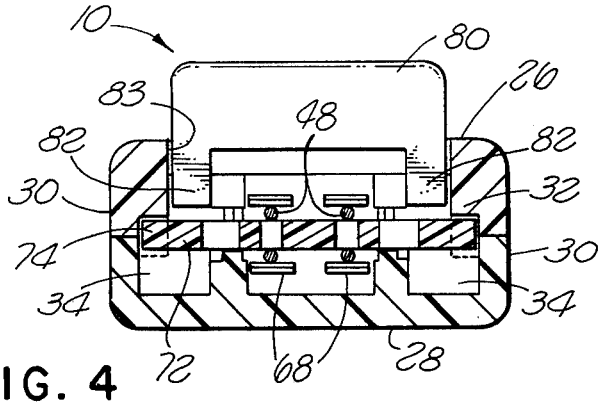
FIG. 4 is a sectional view taken along line 4—4 of FIG. 3 showing the live hinge member of the connector in its normal unstressed condition.
Figure 5:
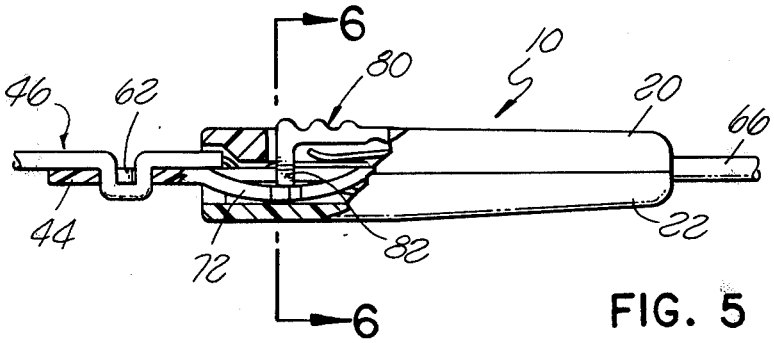
FIG. 5 is a partial longitudinal sectional view through the connector of the invention showing the live hinge member in its actuated position for allowing release of the plug from the receptacle.
Figure 6:
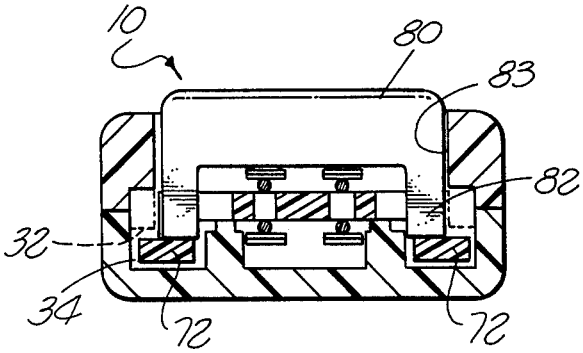
FIG. 6 is a transverse sectional view taking along line 6—6 of FIG. 5.

A live hinge member 80 is integrally formed on the upper part 20 of the receptacle housing. The hinge member extends forwardly and upwardly, as best seen in FIG. 3, and terminates in an inverted, U-shaped forward end having a pair of actuating legs 82. The legs 82 extend downwardly through an opening 83 in the upper wall 26 of the receptacle housing. As best seen in FIG. 4, each leg is positioned over a corresponding one of the resilient arms 72 on the plug plate when the plug is mated with the receptacle. To unmate the connector, the hinge member is deflected downwardly in the direction shown by the arrow in FIG. 6 thereby pushing the arms 72 on the plug downwardly to remove the latching tabs 74 on the arms from behind the latching shoulders 38 on the receptacle housing and to locate such tabs in the release slots 34. Thus, when the plug is pulled in a direction away from the receptacle, the latching tabs can slide forwardly through the release slots 34 until they pass the front of the receptacle housing whereupon the plug and receptacle will be completely disconnected. Hence, it will be appreciated that in order to disconnect the positive latching connector of the present invention, it is necessary first to squeeze the receptacle to deflect the live hinge member 80 downwardly and then pull the plug and receptacle away from each other to unmate the same. By this two step operation, there is less likelihood that the connector will be inadvertently disconnected.

The connector of the present invention has the advantage that it is inexpensive to manufacture, can be blind mated, and has a relatively low profile and, therefore, is suitable for miniaturization. The latching arrangement for the connector of the invention has a very high degree of reliability because of the characteristic of the latching tabs tending to travel outwardly when unmating forces are applied to the connector members.

What is claimed is:

1. A quick detachable coupling comprising:

mating plug and receptacle members mateable along an axial path;

a recess opening at the front of said receptacle member slidably receiving said plug member therein, said recess having a side wall;

means forming a rearwardly facing latching shoulder on said side wall;

means forming a release slot along said side wall opening laterally to said recess, said slot being below and extending rearwardly of said latching shoulder;

said plug member having a body and a latching tab on the side of said body adjacent to said side wall, said tab being movable in two directions relative to said body in a plane transverse to said axial path, one direction being generally perpendicular to the other direction, upon mating of said plug and receptacle members said tab being movable in said one direction to a normal latching position wherein said tab lies behind and is aligned with said shoulder for latching said members together, and said tab being movable in the other direction into said release slot out of alignment with said shoulder when said plug and receptacle members are fully mated; and means for selectively shifting said tab in said other direction into said release slot to allow disengagement of said plug and receptacle members.

2. A coupling as set forth in claim 1 wherein:

an axially extending slot is formed in said body of said plug member adjacent to but spaced from said tab providing a resilient arm which carries said tab, said arm being deflectable away from said shoulder forming means; and cooperating camming surfaces on said receptacle member and said tab causing said arm to deflect inwardly sufficiently to allow said tab to ride over said shoulder forming means upon mating of said plug and receptacle members, said tab snapping into said normal position after moving past said shoulder due to the resilience of said arm.

3. A coupling as set forth in claim 2 wherein:

said selective shifting means engages said arm, actuation of said shifting means in said other direction moving said arm downwardly to locate said tab in said release slot.

4. A coupling as set forth in claim 3 wherein:

said selective shifting means comprises a live hinge member formed on said receptacle.

5. A coupling as set forth in claim 1 including:

a conductor on said body of said plug member and a contact in said recess, said conductor engaging said contact when said plug and receptacle members are mated thereby providing an electrical connector.

6. A quick detachable coupling comprising:

mating plug and receptacle members;

a recess opening at the front of said receptacle member slidably receiving said plug member therein, said recess being formed by upper and lower walls and first and second side walls;

means forming rearwardly facing latching shoulders on said side walls lying in a first plane generally parallel to said upper and lower walls;

means forming release slots below said latching shoulder forming means lying in a second plane generally parallel to said first plane;

said plug member having latching tabs on opposite sides thereof adjacent to said side walls, said tabs normally lying in said first plane behind said shoulders for latching said members together and being vertically movable into said second plane, said tabs also being movable in said first plane toward each other for allowing the positioning of said tabs behind said shoulders upon mating of said plug and receptacle members; and means for selectively shifting said tabs vertically into said release slots in said second plane to allow disengagement of said plug and receptacle members.

7. A coupling as set forth in claim 6 wherein:

said shifting means moves in a plane generally normal to said first and second planes.

8. A coupling as set forth in claim 6 wherein:

axially extending slots are formed in said plug member adjacent to said opposite sides forming resilient arms which carry said tabs, said arms deflecting receptacle members allowing said tabs to ride over said shoulder forming means and expanding outwardly when said tabs pass said shoulders to position said tabs behind said shoulders.

9. A coupling as set forth in claim 8 wherein:

said shoulder forming means embody forwardly facing inclined surfaces; and said tabs have corresponding forwardly facing inclined surfaces engagable with said inclined surfaces on said shoulder forming means causing said arms to deflect inwardly when said plug and receptacle members are mated.

10. A coupling as set forth in claim 8 wherein:

said shifting means comprises a U-shaped member having legs engageable with said arms.

11. A coupling as set forth in claim 10 wherein:

said U-shaped member is formed on a live hinge integral with said upper wall, said upper wall having an opening therethrough through which said U-shaped member extends.

* * * * *